US007052304B2

(12) United States Patent
Yoshida

(10) Patent No.: US 7,052,304 B2
(45) Date of Patent: May 30, 2006

(54) CONNECTOR CAPABLE OF PREVENTING DAMAGES TO ELECTRICALLY CONDUCTIVE TERMINAL

(75) Inventor: Hiroyuki Yoshida, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/998,047

(22) Filed: Nov. 29, 2004

(65) Prior Publication Data

US 2006/0030193 A1 Feb. 9, 2006

(30) Foreign Application Priority Data

Aug. 6, 2004 (JP) ..... 2004-231030

(51) Int. Cl.
*H01R 13/627* (2006.01)

(52) U.S. Cl. ..... 439/362; 439/141

(58) Field of Classification Search ..... 439/362, 439/140–141, 131, 359
See application file for complete search history.

(56) References Cited

U.S. PATENT DOCUMENTS 4,934,950 A * 6/1990 Green et al. ..... 439/681
5,167,516 A * 12/1992 Tan et al. ..... 439/141
5,647,758 A 7/1997 Ichikawa et al. ..... 439/362
6,053,761 A 4/2000 Baron et al. ..... 439/378
6,106,334 A * 8/2000 Kuo ..... 439/610
2002/0001989 A1* 1/2002 Friesen et al. ..... 439/362

FOREIGN PATENT DOCUMENTS

JP 8-250210 9/1996
JP 11-26090 1/1999

* cited by examiner

*Primary Examiner*—Michael C. Zarroli
(74) *Attorney, Agent, or Firm*—Westerman, Hattori, Daniels & Adrian, LLP

(57) ABSTRACT

A connector includes a socket. Electrically conductive pins are inserted into and withdrawn from the inside space of the socket. When the connector is aligned during attachment operation, the electrically conductive pins can be located outside the inside space of the socket. If the other connector of a connector pair is received in the inside space of the socket, the electrically conductive pins are reliably prevented from contacting the other connector. Alignment of the connector relative to the other connector can be realized in a facilitated manner.

3 Claims, 4 Drawing Sheets

CONNECTOR CAPABLE OF PREVENTING DAMAGES TO ELECTRICALLY CONDUCTIVE TERMINAL

BACKGROUND OF THE INVENTION

1. Field of the Invention

The present invention relates to a connector including a socket.

2. Description of the Prior Art

Some connectors include a pair of screw member as disclosed in Japanese Patent Application Publication Nos. 11-26090 and 8-250210, for example. A socket is disposed in a space between the screw members. Electrically conductive terminals such as electrically conductive pins are fixed within the inside space of the socket. When a connector is connected to the other connector of a connector pair, the screw members are aligned with screw bores of the other connector. The screw members are screwed into the screw bores, respectively. The socket is thereafter inserted into the socket of the other connector. The electrically conductive terminals are thus connected to the electrically conductive terminals of the other connector.

The screw members of the aforementioned connector are screwed into the screw bores prior to the insertion of the socket. The connector is previously positioned at a predetermined position. The electrically conductive terminals are then received straight into the other connector. The electrically conductive terminals are thus prevented from damages. However, the other connector is usually fixed on the enclosure of an electronic apparatus, for example. The screw bores merely have a smaller diameter. Moreover, the operator should align the screw members with the screw bores in the air without any supports or guides.

SUMMARY OF THE INVENTION

It is accordingly an object of the present invention to provide a connector contributing to a facilitated alignment without damages to an electrically conductive terminal.

According to the present invention, there is provided a connector comprising: a socket having an inside space; and an electrically conductive terminal being inserted into and withdrawn from the inside space of the socket.

When the connector is aligned during attachment operation, the electrically conductive terminal can be located outside the inside space of the socket. If the other connector of a connector pair is received in the inside space of the socket, for example, the electrically conductive terminal is reliably prevented from contacting the other connector. The electrically conductive terminal is surely prevented from suffering from damages. The socket may receive the other connector when the connector is to be aligned. Alternatively, the socket may be received in the other connector when the connector is to be aligned. Alignment of the connector relative to the other connector can be realized in a facilitated manner.

The connector may further comprise: a support member supporting the electrically conductive terminal; and a screw member connected to the support member for relative rotation without movement in a longitudinal direction, said screw member threaded rearward from the front end.

When the connector is positioned relative to the other connector with the assistance of the socket, the screw member is simultaneously positioned at corresponding screw bores of the other connector, for example. Attachment operation of the connector can thus be facilitated. In addition, when the screw member is screwed into the other connector, the support member advances. The advancement of the support member enables a forward movement of the electrically conductive terminal. The movement of the electrically conductive terminal is related to the movement of the screw member. The insertion and withdrawal of the electrically conductive terminal into and from the socket can be realized in this manner.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
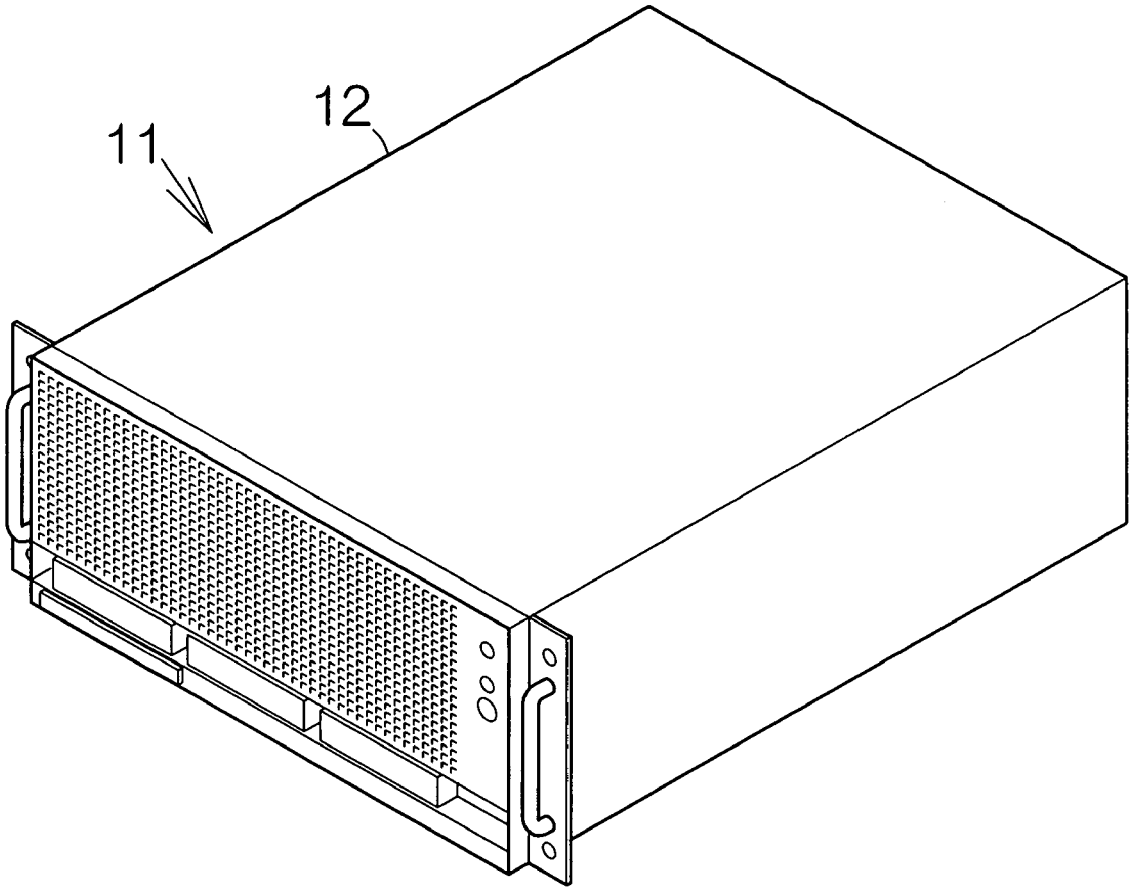
FIG. 1 is a perspective view schematically illustrating a serve computer apparatus as an electronic apparatus according to an embodiment of the present invention.

FIG. 1 schematically illustrates a server computer apparatus 11 as an example of an electronic apparatus according to an embodiment of the present invention. The server computer apparatus 11 is mounted in a rack, for example. The server computer apparatus 11 includes an enclosure 12 containing a main board, for example. Electronic circuit elements such as a central processing unit (CPU), a memory, and the like, are mounted on the main board. The CPU is designed to execute various processings based on software programs and/or data temporarily stored in the memory, for example. The software programs and data may be stored in a mass storage such as a hard disk drive (HDD) likewise contained within the enclosure 12.

Figure 2:
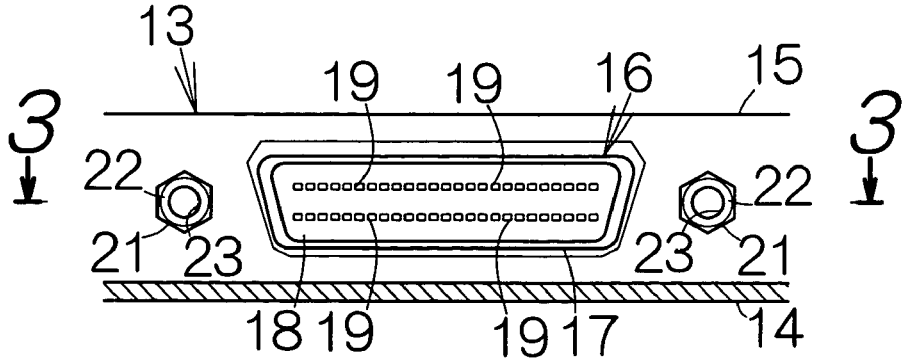
FIG. 2 is a front view of a connector incorporated in the enclosure of the server computer apparatus.

As shown in FIG. 2, a SCSI (small computer system interface) array controller card 13 is mounted in the back plate of the enclosure 12, for example. The controller card 13 includes a printed circuit board 14 and a metallic plate 15 standing upright from the surface of the printed circuit board 14. The controller card 13 may be inserted into a slot, not shown, defined in the enclosure 12. A connector 16 of the SCSI standard is attached to the metallic plate 15. The connector 16 may be mounted on the printed circuit board 14. The connector 16 serves to couple an exterior storage device such as a HDD with the main board, for example.

The connector 16 includes a socket 17 protruding from the outer surface of the metallic plate 15. The socket 17 comprises a surrounding wall standing from the outer surface of the metallic plat 15. The surrounding wall may be made of an electrically conductive material such as a metal. A resin member 18 is incorporated within the socket 17. Pinholes 19, 19, . . . are bored in the resin member 18. Elastic terminals or contacts, not shown, are fixed within the pin holes. The elastic contacts function as electrically conductive terminals or contacts. The pinholes 19 may be arranged in accordance with the standard.

A pair of bolt 21, 21 having a hexagonal head is screwed into the metallic plate 15 of the controller card 13. The bolt 21 includes a stem coupled to the connector 16, as described later in detail. The connector 16 is fixedly coupled to the controller card 13 in this manner. A bottomed bore 23 is formed in a screw head 22 of the bolt 21. The bottomed bore 23 extends along the longitudinal axis of the bolt 21 toward the stem. The bottomed bore 23 is threaded. The bottomed bore 23 of the bolt 21 is designed to receive insertion of a screw member, as described later.

Figure 3:
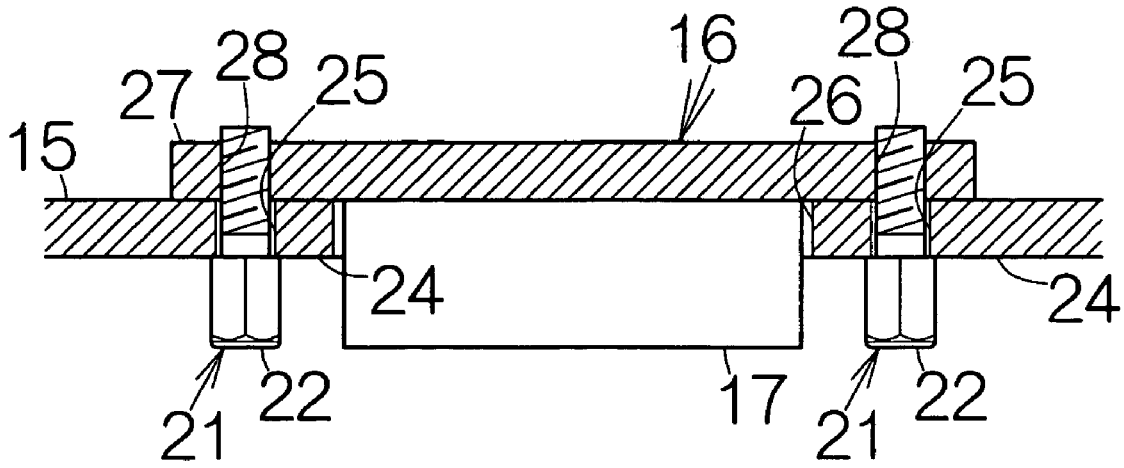
FIG. 3 is a sectional view taken along the line 3—3 in FIG. 2.

As shown in FIG. 3, a flat surface 24 is defined on the outer surface of the metallic plate 15. A pair of columnar attachment hole, namely through hole 25, 25 is formed in the flat surface 24. The stem of the bolt 21 is received in the through hole 25. The longitudinal axis of the bolt 21 is set perpendicular to the flat surface 24.

A receptacle opening 26 is defined in the flat surface 24. The receptacle opening 26 penetrates through the metallic plate 15. When a connector body 27 of the connector 16 is overlaid on the inside surface of the metallic plate 15, the socket 17 of the connector 16 is received in the receptacle opening 26.

Female screws 28 are threaded in the connector body 27. The stems of the bolts 21 are received in the respective female screws 28. The height of the bolts 21 from the flat surface 24 is set equal to the height of the socket 17 from the flat surface 24.

Figure 4:
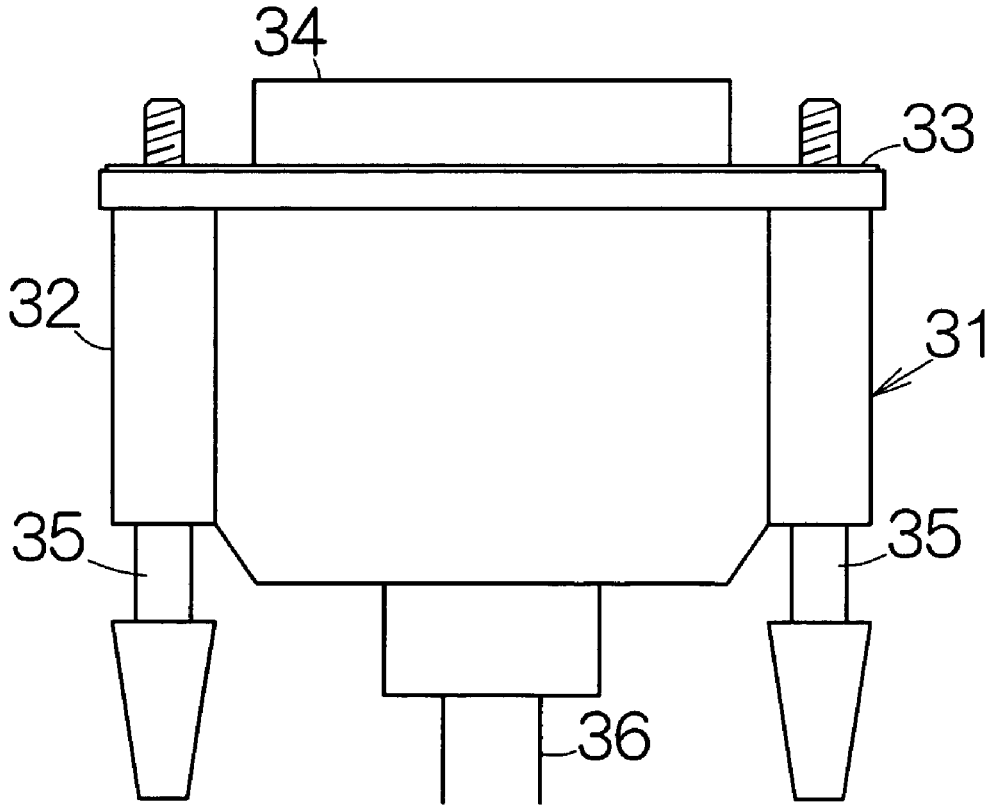
FIG. 4 is a plan view schematically illustrating a connector according to an embodiment of the present invention.

FIG. 4 schematically illustrates the structure of a connector 31 according to an embodiment of the present invention. The connector 31 is connected to the other connector of the connector set, namely the connector 16. The connecter 31 is a connector of the SCSI standard in the same manner as the connector 16. The connector 31 includes a cover 32 defining the inside space. The cover 32 may be made of resin material, for example. The inside space of the cover 32 is closed with a front plate 33 located at the front end of the cover 32. The front plate 33 may be made of an electrically conductive material such as a metal, for example.

A socket 34 is formed on the front plate 33 so as to protrude from the front plate 33. The socket 34 is integral to the front plate 33. The socket 34 comprises a surrounding wall standing upright from the front plate 33. The socket 17 is designed to receive insertion of the socket 17 of the connector 16. The inside space of the socket 34 may be set slightly larger than the outer contour of the socket 17. The inside space of the socket 34 is continuously connected to the inside space of the cover 32.

A pair of screw member, namely male screw 35, 35 is assembled in the cover 32. The male screw 35 defines a screw thread on the stem near the front end. The male screws 35 are received in through holes, not shown, formed in the front plate 33 and the rear wall of the cover 32, respectively. The male screws 35 are allowed to penetrate through the inside space of the cover 32 through the through holes. The male screws 35 are set perpendicular to the surface of the front plate 33. The male screws 35 are designed to move forward and backward relative to the cover 32. A cable 36 penetrates through the rear wall of the cover 32 in the connector 31. Here, the other end of the cable 36 may be coupled to a HDD connected to the server computer apparatus 11, for example.

Figure 5:
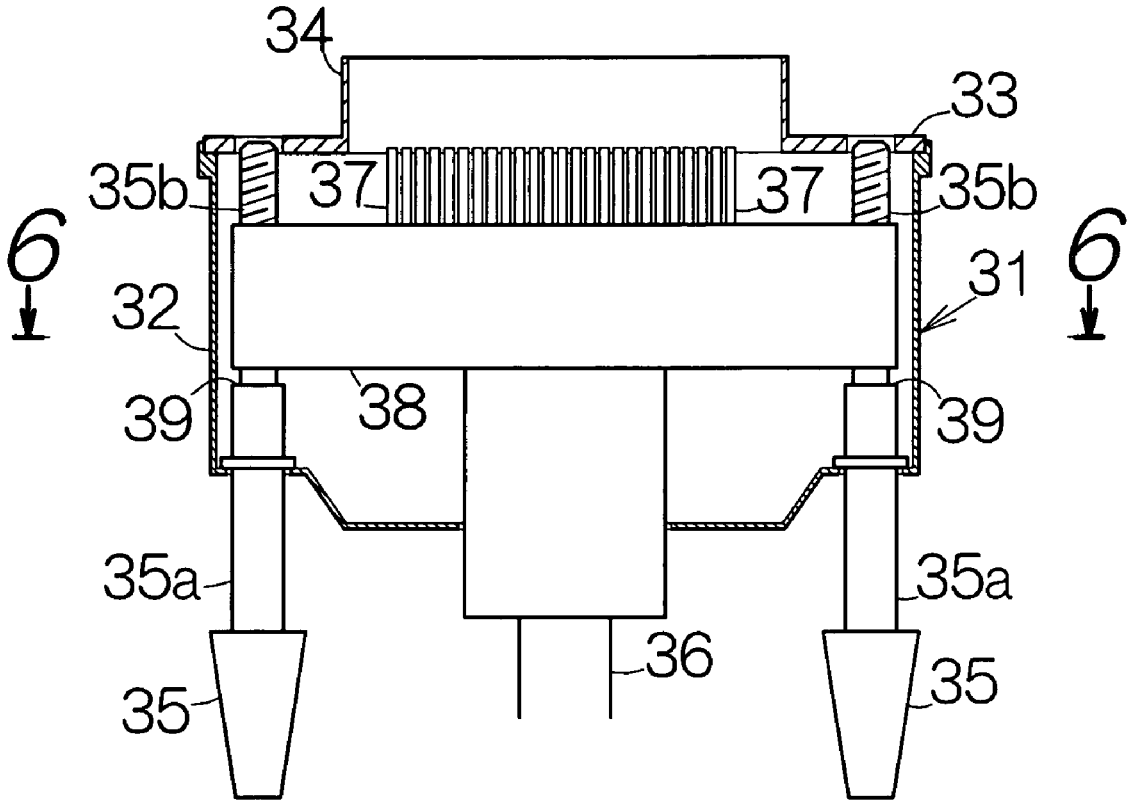
FIG. 5 is a partial sectional view schematically illustrating the inner structure of the connector.

As shown in FIG. 5, electrically conductive terminals or pins 37, 37, . . . are contained within the inside space of the cover 32. The electrically conductive pins 37 are inserted into and withdrawn from the inside space of the socket 34 as described later in detail. The electrically conductive pins 37 are designed to be received in the pin holes 19 of the connector 16, respectively. The electrically conductive pins 37 are supported on the support member 38. The electrically conductive pins 37 may be arranged in accordance with the standard. Electrically conductive lines, not shown, are disposed within the support member 38. The electrically conductive pins 37 are respectively connected to the electrically conductive lines. The electrically conductive lines are located within the cable 36. The support member 38 may be made of resin material.

The male screws 35, 35 include a first columnar stem 35*a* defined near the rear end and a second columnar stem 35*b* located adjacent the first columnar stem 35*a* closer to the front end. As is apparent from FIG. 5, the outer diameter of the second columnar stem 35*b* is set smaller than that of the first columnar stem 35*a*. The longitudinal axis of the first columnar stem 35*a* is aligned with the longitudinal axis of the second columnar stem 35*b*. An annular step 39 is defined between the first and second columnar stems 35*a*, 35*b*. The opposite ends of the support member 38 are coupled to the second columnar stems 35*b* of the male screws 35.

Figure 6:
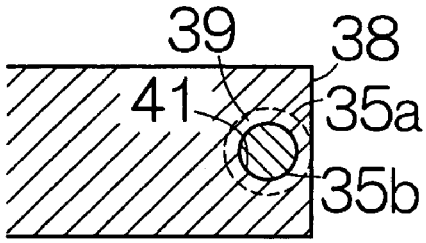
FIG. 6 is a sectional view taken along the line 5—5 in FIG. 5.

Referring also to FIG. 6, columnar receiving holes or through holes 41 are defined in the support member 38. The second columnar stem 35*b* of the male screw 35 is received in the through hole 41. The male screws 35 are coupled to the support member 38 for relative rotation around the longitudinal axes. At the same time, the support member 38 is coupled to the second columnar stem 35*b* for a relative longitudinal movement. When the support member 38 is positioned at the rear end of the second columnar stem 35*b*, the rear end of the support member 38 is received on the steps 39 of the male screws 35. The male screws 35 are thus coupled to the support member 38 so that the male screws 35 are prohibited to move forward relative to the support member 38 in the longitudinal direction. The forward movement of the male screws 35 allows the steps 39 to drive the support member 38 forward in the longitudinal direction. Specifically, the step 39 functions as an urging surface of the support member 38.

Figure 7:
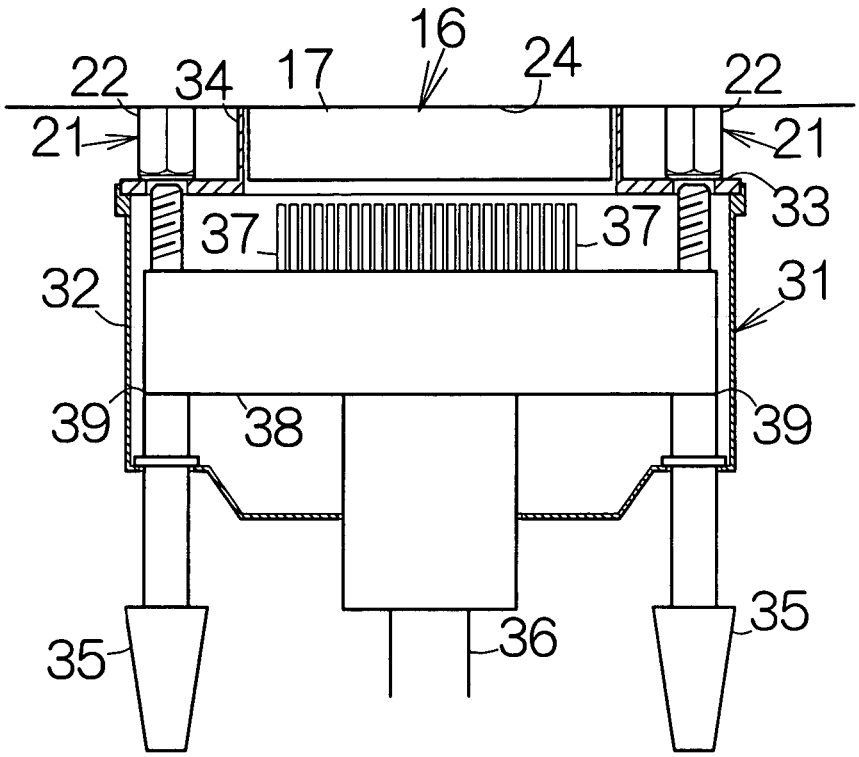
FIG. 7 is a partial sectional view illustrating the connector during attachment operations.

Now, assume that the connector 31 is coupled to the connector 16. As shown in FIG. 5, the rear end of the support member 38 is received on the steps 39 of the male screws 35 in the connector 31. The electrically conductive pins 37 are located outside the inside space of the socket 34, namely, within the inside space of the cover 32. When the connector 31 is urged against the connector 16, the socket 34 of the connector 31 receives the insertion of the socket 17 of the connector 16. As shown in FIG. 7, the tip end of the socket 34 is received on the flat surface 24. The socket 34 thus serves to properly position the connector 31 relative to the connector 16. Since the electrically conductive pins 37 are located within the inside space of the cover 32, the electrically conductive pins 37 are reliably prevented from contacting the pin holes 19.

Figure 8:
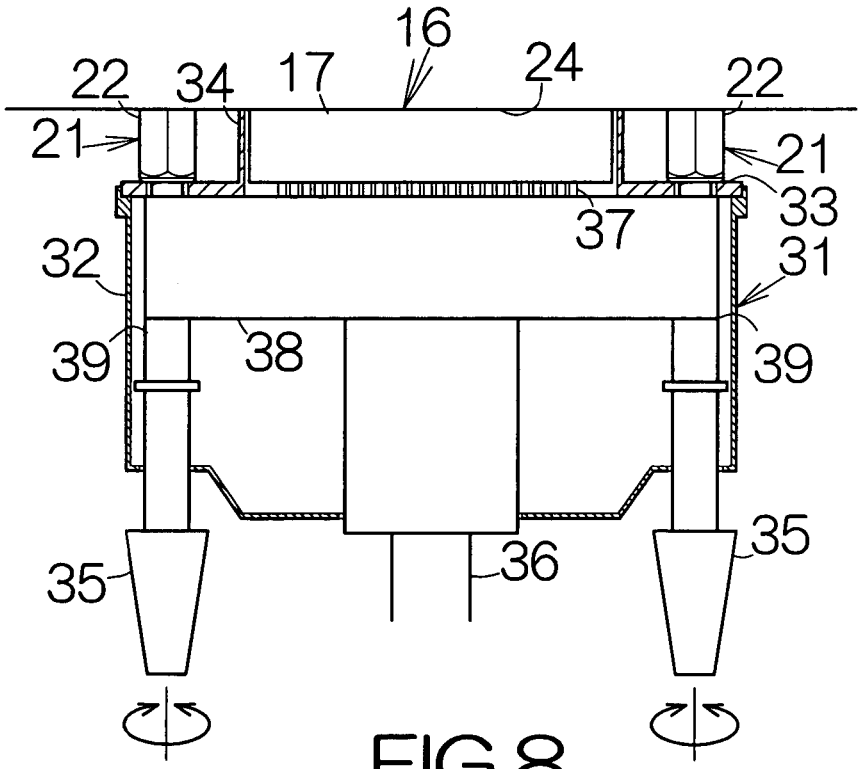
FIG. 8 is a partial sectional view illustrating the connector during attachment operations.

Here, the front plate 33 of the connector 31 is received on the screw heads 22 of the bolts 21. The male screws 35 are thus positioned straight to the corresponding bottomed bores 23 of the bolts 21. When the male screws 35 are screwed into the bottomed bores 23 of the bolts 21, the steps 39 of the male screws 35 urge the support member 38 forward toward the connector 16. The electrically conductive pins 37 thus advance into the pin holes 19 of the connector 16. Since the movement of the support member 38 is guided along the male screws 35, the electrically conductive pins 37 are allowed to get straight into the corresponding pin holes 19. The electrically conductive pins 37 are surely prevented from being bent. Avoidance of existence of a bent electrically conductive pin leads to a reliable establishment of electric connection between the connectors 16, 31. When the male screws 35 have completely been inserted into the bottomed bores 23 of the bolts 21, the front end of the support member 38 is received on the inside surface of the front plate 33, as shown in FIG. 8. The individual electrically conductive pins 37 sufficiently get into the corresponding pin holes 19. The connector 31 is in this manner coupled to the connector 16.

Next, assume that the connector 31 is removed from the connector 16. First of all, the male screws 35 are withdrawn from the bottomed bores 23 of the bolts 21. The bolts 21 are loosened. The male screws 35 move backward in the through holes 41 of the support member 38. Here, since the support member 38 keeps staying, the steps 39 of the male screws 35 get distanced from the rear end of the support member 38. The connection is maintained between the electrically conductive pins 37 and the elastic contacts in the pin holes 19.

The cover 32 is then moved from the connector 16. Specifically, the socket 34 of the connector 31 is withdrawn from the socket 17 of the connector 16. Since the front end of the support member 38 is received on the front plate 33, the withdrawal of the cover 32 from the connector 16 causes the electrically conductive pins 37 to get out of the pin holes 19. The connector 31 is thus completely removed from the connector 16.

The server computer apparatus 11 allows insertion and withdrawal of the electrically conductive pins 37 into and from the socket 34. The electrically conductive pins 37 are located within the inside space of the cover 32 during the alignment of the connector 31. Even when the socket 17 of the connector 16 is received in the inside space of the socket 34, the electrically conductive pins 37 are prevented from contacting the pin holes 19 of the connector 16. The electrically conductive pins 37 are reliably prevented from damages.

In addition, the socket 34 is simply inserted into the socket 17 of the connector 16 when the connector 31 is to be positioned relative to the connector 16. The connector 31 is thus positioned relative to the connector 16 without any difficulty. The user is allowed to easily position the connector 31 even with one hand. The alignment of the connector 31 in this manner serves to position the male screws 35 right at the corresponding bottomed bores 23. Attachment of the connector 31 can be realized with facilitated operations.

Moreover, the support member 38 is allowed to freely move forward and backward along the second columnar stems 35*b* of the male screws 35. When the connector 31 is positioned with the electrically conductive pins 37 located within the inside space of the socket 34, the support member 38 along with the electrically conductive pins 37 is allowed to move backward due to the contact of the electrically conductive pins 37 with the resin member 17 or the pin holes 19. No bending force is applied to the individual electrically conductive pins 37. The electrically conductive pins 37 are reliably prevented from damages.

What is claimed is:

1. A connector comprising:

a cover having an inside space;

a socket coupled to the cover and having an inner space;

an electrically conductive terminal located in the inside space of the cover;

a support member supporting the electrically conductive terminal, said support member achieving forward and rearward movements in a longitudinal direction so as to allow insertion and withdrawal of the electrically conductive terminal into and from the inner space of the socket; and a screw member connected to the support member so as to drive the support member for the forward movement in response to a forward movement of the screw member, said screw member threaded rearward from a front end.

2. The connector according to claim 1, wherein the screw member comprising:

a first columnar stem;

a second columnar stem connected to a front end of the first colunmar stem in a coaxial relation, the second columnar stem passing through the support member for relative rotation, an outer diameter of the second columnar stem being set smaller than that of the first columnar stem; and an annular step defined at the front end of the first columnar stem so as to receive a rear of the support member.

3. The connector according to claim 1, further comprising:

a front plate coupled to a front end of the cover, the front plate serving to close the inside space of the cover, the socket being formed on the front plate so as to protrude forward from the front plate; and a through hole defined in the front plate for receiving the screw member.

* * * * *